US006707372B2

(12) United States Patent
Davis et al.

(10) Patent No.: US 6,707,372 B2
(45) Date of Patent: Mar. 16, 2004

(54) THERMAL SWITCH CONTAINING PREFLIGHT TEST FEATURE AND FAULT LOCATION DETECTION

(75) Inventors: George D Davis, Bellevue, WA (US); Byron G Scott, Arlington, WA (US)

(73) Assignee: Honeywell International, Inc., Morristown, NJ (US)

( * ) Notice: Subject to any disclaimer, the term of this patent is extended or adjusted under 35 U.S.C. 154(b) by 73 days.

(21) Appl. No.: 09/966,460

(22) Filed: Sep. 27, 2001

(65) Prior Publication Data

US 2002/0080006 A1 Jun. 27, 2002

Related U.S. Application Data

(60) Provisional application No. 60/237,847, filed on Oct. 4, 2000.

(51) Int. Cl.[7] ..... H01H 37/54; H01H 37/32

(52) U.S. Cl. ..... 337/376; 337/343; 337/300

(58) Field of Search ..... 337/1–3, 12, 13, 337/16, 36, 53, 79, 85, 89, 299, 333, 343, 365, 376, 417, 300

(56) References Cited

U.S. PATENT DOCUMENTS 3,840,834 A * 10/1974 Obenhaus et al. ..... 337/79
4,306,210 A * 12/1981 Saur ..... 337/2
4,849,729 A * 7/1989 Hofsass ..... 337/102
5,023,744 A * 6/1991 Hofsass ..... 361/26
5,048,974 A * 9/1991 Dupuy ..... 374/142
5,337,036 A * 8/1994 Kuczynski ..... 337/343
5,607,610 A * 3/1997 Furukawa ..... 219/505
5,615,072 A * 3/1997 Hofsass et al. ..... 361/24
5,627,506 A * 5/1997 Suzuki ..... 337/298
5,757,261 A * 5/1998 Becher et al. ..... 337/377
5,892,429 A * 4/1999 Hofsass ..... 337/377
5,973,587 A * 10/1999 Hofsass ..... 337/377
6,020,807 A * 2/2000 Givler ..... 337/377

FOREIGN PATENT DOCUMENTS

EP 564150 A1 * 10/1993 ..... H01H/1/50
JP 63314734 A * 12/1988 ..... H01H/37/54

* cited by examiner

*Primary Examiner*—Anatoly Vortman
(74) *Attorney, Agent, or Firm*—Charles J. Rupnick

(57) ABSTRACT

An integral resistance element combined with a snap-action thermal switch and coupled to an output thereof, the snap-action thermal switch being structured in a normally-open configuration. The resistance element and the snap-action thermal switch share one or more common terminals. The snap-action thermal switch is structured having a pair of terminals being mutually electrically isolated when the snap-action thermal switch structured in the normally open configuration, and the integral resistance element is electrically coupled to provide an output on the pair of electrically isolated terminals.

8 Claims, 13 Drawing Sheets

THERMAL SWITCH CONTAINING PREFLIGHT TEST FEATURE AND FAULT LOCATION DETECTION

This application claims the benefit of U.S. Provisional Application Serial No. 60/237,847, filed in the names of George D. Davis and Byron G. Scott on Oct. 4, 2000, the complete disclosure of which is incorporated herein by reference.

FIELD OF THE INVENTION

The present invention is directed to temperature sensors and, more particularly, to snap-action thermal switches and resistance thermal sensors.

BACKGROUND OF THE INVENTION

Snap-action thermal switches are utilized in a number of applications, such as temperature control and overheat detection of mechanical devices such as motors and bearings. In some applications, multiple thermal switches are located at different positions around the equipment. For example, in some aircraft wing, fuselage, and cowling overheat detection applications, multiple thermal switches located just behind the leading edge flap, while other thermal switches are spaced along the length of each wing. Additional thermal switches are located in the engine pylon and where the wing attaches to the fuselage. In this example, the multiple thermal switches are connected electrically in parallel, such that just two wires are used to interface between all of the switches on each wing and an instrument that monitors the temperature of the aircraft's wing, fuselage, and cowling.

Current snap-action thermal switch designs typically provide open and closed functions only. Typically, all of the thermal switches in the aircraft wing, fuselage, and cowling overheat detection applications are operated in the normally open state. The thermal switches are thus all in the "open" state until an overheat condition is detected, at which time one or more of the switches change to the "closed" state, thereby completing the circuit causing a "right wing," "left wing" or "fuselage" overheat indication to appear in the cockpit. The pilot then follows the appropriate procedure to reduce the overheat condition.

Current snap-action thermal switches used in parallel operation, multiple thermal switch overheat detection systems suffer from various drawbacks. The integrity of the wire harness between the cockpit and the wing tip cannot be assured because the circuit is always open under normal operating conditions. If a switch connector is not engaged or the wire harness contains a broken lead wire, a malfunction indication will not occur, but neither will the overheat detection system operate during an actual in-flight overheat condition. Furthermore, if an overheat condition does occur, current snap-action thermal switches are not equipped to provide information describing the exact location of the overheat. In both instances, flight safety is compromised, and later correction of the problem that caused the overheat condition is made more difficult because of the inability to pinpoint the overheat fault.

SUMMARY OF THE INVENTION

The present invention overcomes the limitations of the prior art by providing a device that provides a self-test function in combination with a thermal overheat detection function.

According to one embodiment of the invention, a snap-action thermal switch structured in a normally open configuration is combined with a resistance element integral with the snap-action thermal switch and coupled to an output thereof.

According to one embodiment of the invention, the resistance element and the snap-action thermal switch share one or more common terminals. For example, the snap-action thermal switch is structured having a pair of terminals being mutually electrically isolated when the snap-action thermal switch structured in the normally open configuration, and the integral resistance element is electrically coupled to provide an output on the pair of electrically isolated terminals. According to different embodiments of the invention, the resistance element is mounted either internally or externally to the snap-action thermal switch.

According to another embodiment, the invention is embodied as a three-terminal, snap-action thermal switch having first, second and third electrical terminals mounted in a header, the first, second and third terminal being mutually spaced apart and electrically isolated; a fixed electrical contact being positioned on the first terminal; a movable electrical contact being positioned on the second terminal and being biased into electrical contact with the fixed electrical contact; a bi-metallic actuator being convertible as a function of temperature between a first state wherein an actuation portion is positioned to space the movable electrical contact away from the fixed electrical contact and a second state wherein the actuation portion is positioned to permit electrical contact between the movable electrical contact and the fixed electrical contact; and an electrically resistive element coupled between the third electrical terminal and one of the first and second electrical terminals.

The invention also provides methods of accomplishing the same. For example, the method of the invention includes structuring a pair of electrical contacts in a normally open configuration; electrically interconnecting an electrically resistive element with at least one of the pair of contacts; and detecting a minimum electrical resistance of the electrically resistive element.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF PREFERRED EMBODIMENT

In the Figures, like numerals indicate like elements.

The present invention is a thermal protection device that provides a resistor in combination with a normally open, snap-action thermal switch until the switch changes state from open to closed. This resistor in combination with a normally open, snap-action thermal switch provides several advantages over typical thermal protection devices. For example, the resistor provides a means for determining if switch connector is not engaged, or the wire harness contains a broken lead wire. In these and like circumstances a malfunction indication will occur during pre-flight check or en route, if the failure occurs during flight. While the overheat detection system remains operational, a malfunction indication will occur during an actual in-flight overheat condition. Furthermore, if an overheat condition does occur, the thermal switch of the present invention is equipped with the serial connected resistor to provide information describing an exact location of the overheat. Flight safety is thereby enhanced, and later correction of the problem that caused the overheat condition is simplified because of the ability to pinpoint the location of the overheat fault.

Figure 1:
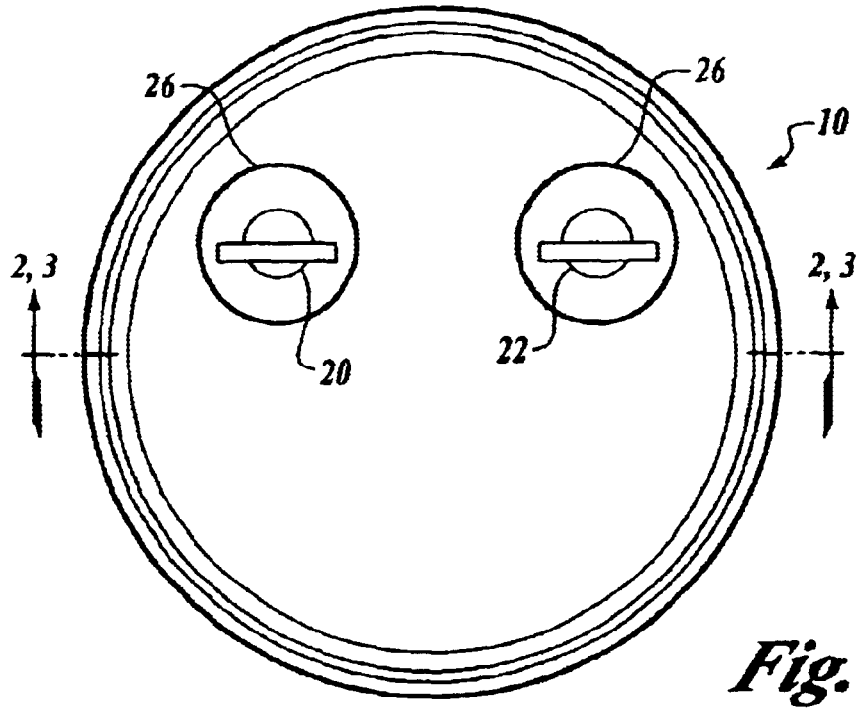
FIG. 1 is a top plan view of the present invention embodied as a single-pole, single-throw snap-action thermal switch having an interiorly mounted resistor.
Figure 2:
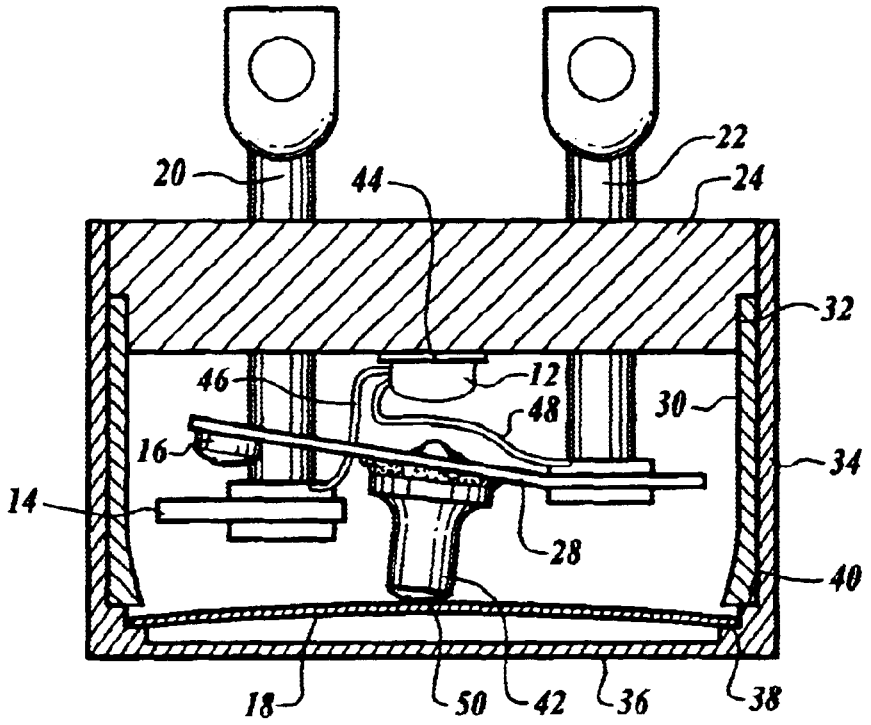
FIG. 2 is a cross-sectional view of the snap-action thermal switch of the present invention embodied as shown in FIG. 1 with the contacts open and showing the interiorly mounted resistor.

FIG. 1 is a top plan view and FIG. 2 is a cross-sectional view of the present invention embodied as a snap-action thermal switch 10 having an internally mounted resistor 12. The thermal switch 10 includes a pair of electrical contacts 14, 16 that are mounted on the ends of a pair of spaced-apart, electrically conductive terminal posts 20 and 22. The electrical contacts 14, 16 are moveable relative to one another between an open and a closed state under the control of a thermally-responsive actuator 18. According to one embodiment of the invention, the thermally-responsive actuator 18 is a well-known snap-action bimetallic disc that inverts with a snap-action as a function of a predetermined temperature between two bi-stable oppositely concave and convex states. In a first state, the bimetallic disc actuator 18 is convex relative to the relatively moveable electrical contacts 14, 16, whereby the electrical contacts 14, 16 are moved apart such that they form an open circuit. In a second state, the bimetallic disc actuator 18 is concave relative to the relatively moveable electrical contacts 14, 16, whereby the electrical contacts 14, 16 are moved together such that they form an closed circuit.

As illustrated in FIGS. 1 and 2, the thermal switch 10 includes the two terminal posts 20, 22 mounted in a header 24 such that they are electrically isolated from the header 24 and from one anther. For example, the terminal posts 20, 22 are mounted in the header 24 using an electrical isolator 26 (shown in FIG. 1) formed of an electrically isolating glass or epoxy material.

As shown in FIG. 2, the contact 14 is fixed on the lower end of one terminal post 20. The contact 16 is moveable on the end of a carrier 28 in the form of an armature spring, which is fixed in a cantilever fashion to the lower end of the other terminal post 22. The electrical contacts 14, 16 thus provide an electrically conductive path between the terminal posts 20, 22. Upward pivoting of the armature spring 28 moves the movable contact 16 out of engagement with the fixed contact 14, whereby an open circuit is created. Downward pivoting of the armature spring 28 moves the movable contact 16 into engagement with the fixed contact 14, whereby the terminal posts 20, 22 are shorted and the circuit is closed.

The movable contact 16 is controlled by the disc actuator 18, which is spaced away from the header 24 by a spacer ring 30 interfitted with a peripheral groove 32. A cylindrical case 34 fits over the spacer ring 30, thereby enclosing the terminal posts 20, 22, the electrical contacts 14, 16, and the disc actuator 18. The case 34 includes a base 36 with a pair of annular steps or lands 38 and 40 around the interior thereof and spaced above the base. The lower edge of the spacer ring 30 abuts the upper case land 40. The peripheral edge of the disc actuator 18 is captured within an annular groove created between the lower end of the spacer ring 30 and the lower case land 38.

As shown in FIG. 2, while the thermal switch 10 is maintained below a predetermined overheat temperature, the disc actuator 18 is maintained concave relationship to the electrical contacts 14, 16. The concave disc actuator 18 pivots the armature spring 28 upwardly to separate the contacts 14, 16 through the intermediary of a striker pin 42 fixed to the armature spring 28. Separation of the contacts 14 and 16 creates normally open circuit condition.

The resistor 12 is mounted to the interior of the thermal switch 10 and electrically connected to the two terminal posts 20, 22. For example, the resistor 12 is bonded to an inner surface of the header 24 using a bonding agent 44, such as an epoxy. Lead wires 46, 48 attached to the resistor 12 are electrically coupled to each of the terminal posts 20, 22. For example, the lead wires 46, 48 are spot welded to an outer surface of the corresponding terminal post 20, 22. The output of the internally mounted resistor 12 is available on the terminal posts 20, 22 while the electrical contacts 14, 16 provide an open circuit.

The thermal switch 10 is sealed to provide protection from physical damage. The thermal switch 10 is optionally hermetically sealed with a dry Nitrogen gas atmosphere having trace Helium gas to provide leak detection, thereby providing the electrical contacts 14, 16 and the internal resistor 12 with a clean, safe operating environment.

Figure 3:
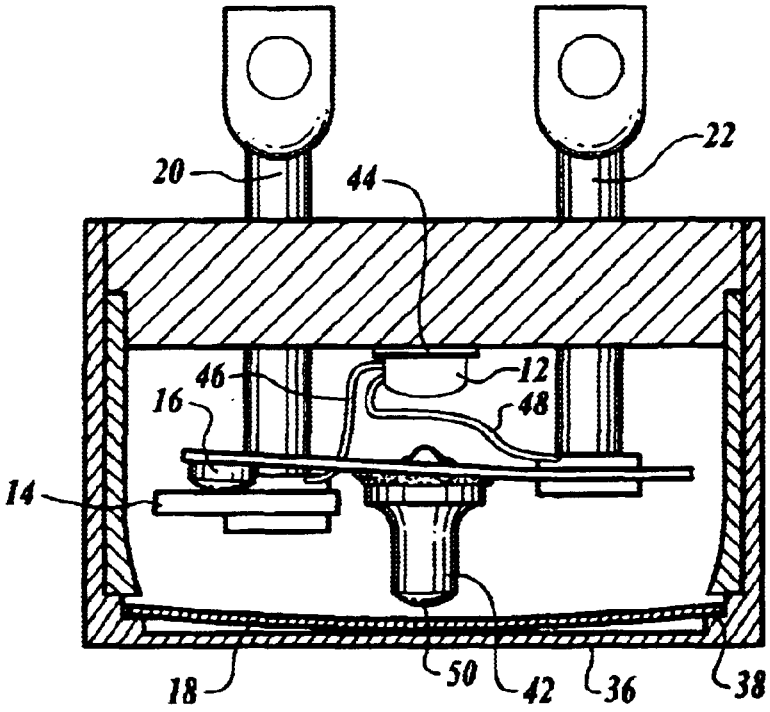
FIG. 3 is a cross-sectional view of the snap-action thermal switch of the present invention embodied as shown in FIG. 1 with the contacts closed and showing the interiorly mounted resistor.

FIG. 3 illustrates the thermal switch 10 as a closed circuit, wherein the contacts 14, 16 are shorted. In response to a increase in the sensed ambient temperature above a predetermined set point, the disc actuator 18 inverts in a snap-action into a concave relationship with the electrical contacts 14, 16, the disc actuator 18 entering a space between the lower case land 38 and the case end 36. The lower end 50 of the striker pin 42 is normally spaced a distance from the actuator disc 18 so that slight movement of the actuator disc 18 will not effect contact engagement. The armature spring 28 is pivoted downwardly, which moves the movable contact 16 into engagement with the fixed contact 14, thereby creating a short and closing the circuit. The output of the internal resistor 12 is not available when the electrical contacts 14, 16 are shorted and the circuit is closed. As described in detail below, removal of the resistance of the internal resistor 12 identifies the particular switch that has responded to an overheat condition so that the location of the overheat event is identified.

Due to the nature of the snap-action disc actuator 18, the output of the internal resistor 12 becomes available again when the sensed ambient temperature is reduced below the predetermined set point and the disc actuator 18 returns to its convex state relative to the electrical contacts 14, 16, so that the resistance of the internal resistor 12 is again presented with an open circuit on the two terminal posts 20, 22.

Figure 4:
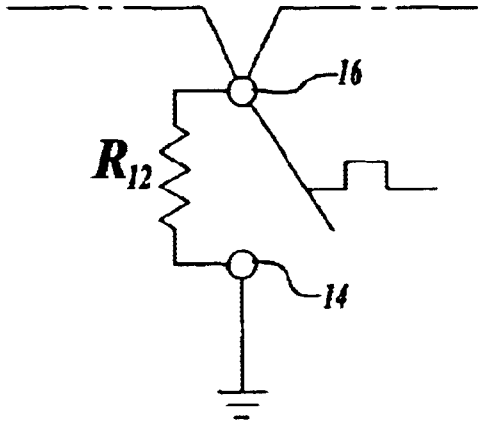
FIG. 4 is a schematic description of the single-pole, single-throw thermal switch shown in FIGS. 1 through 3.

FIG. 4 is a schematic description of the single-pole, single-throw thermal switch 10 shown in FIGS. 1 through 3. As illustrated, the single-pole, single-throw thermal switch 10 is structured such that a resistance R12 is by-passed when the switch contacts 14, 16 are closed.

Figure 5:
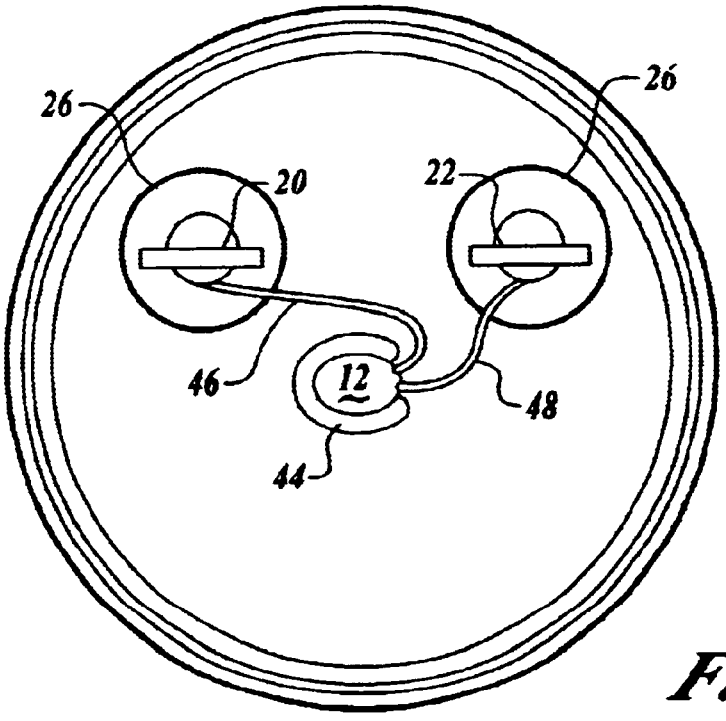
FIG. 5 is a top plan view of one alternative embodiment of the present invention embodied as a snap-action thermal switch having an externally mounted resistor.
Figure 6:
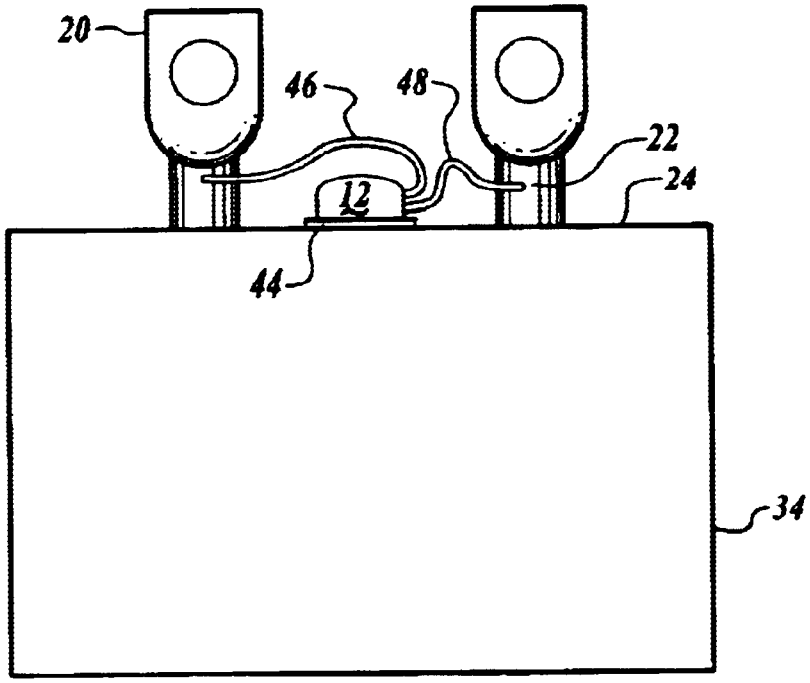
FIG. 6 is a side view of the snap-action thermal switch of the present invention embodied as shown in FIG. 5.

FIGS. 5 and 6 illustrate an alternate embodiment of the invention wherein the resistor 12 is installed on an exterior surface 52 of the thermal switch 10 and the lead wires 46, 48 are attached to exterior surfaces of the terminal posts 20, 22 of the thermal switch 10. The internal resistor 12 is, for example, bonded to the exterior surface 54 of the header 24, as shown in FIGS. 4 and 5.

Figure 7:
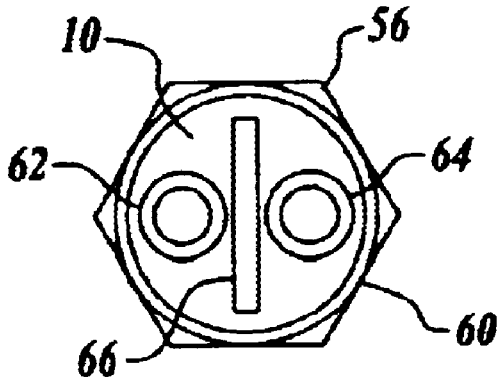
FIG. 7 is a top plan view of one alternative embodiment of the present invention embodied as a snap-action thermal switch having an externally mounted resistor, the thermal switch installed in an over-molded housing configured for mounting in an aircraft wing, fuselage, or cowling, as shown in FIG. 17.
Figure 8:
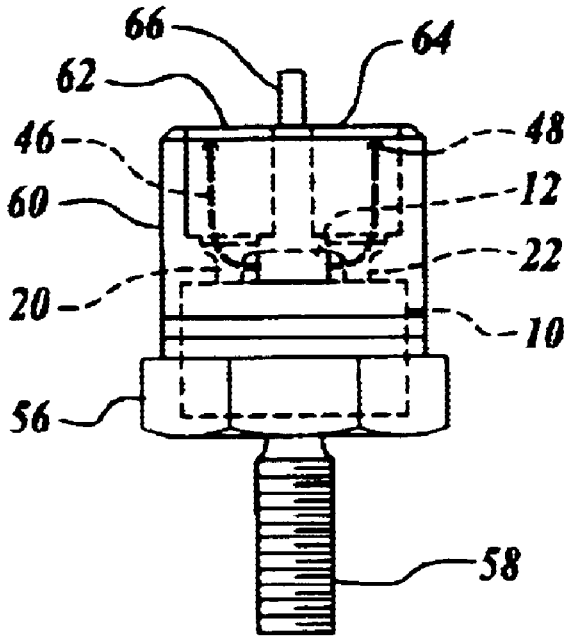
FIG. 8 is a side view of the snap-action thermal switch of the present invention embodied as shown in FIG. 7 and shows the externally mounted resistor.
Figure 17:
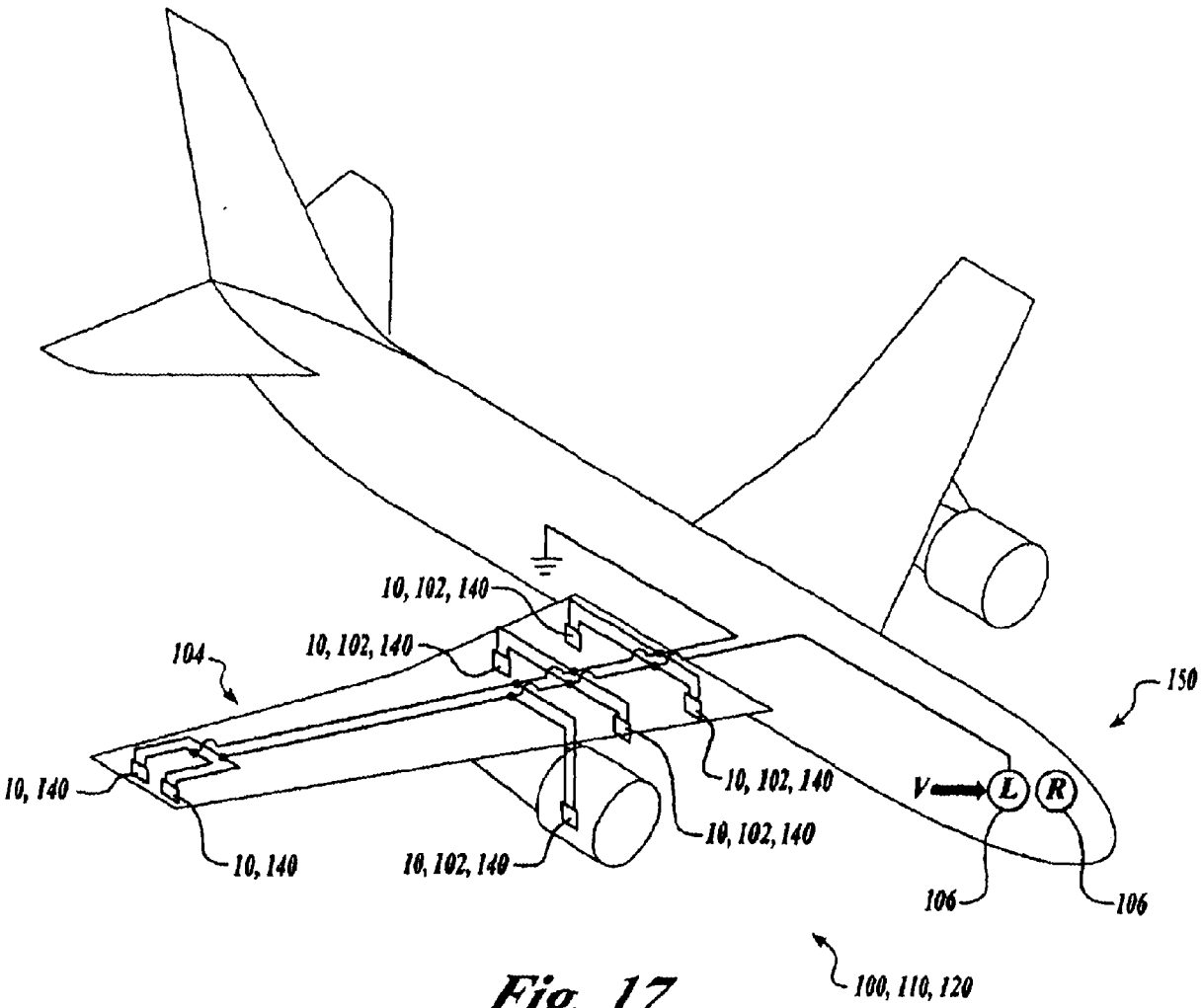
FIG. 17 illustrates the overheat detection system of the invention having the thermal switch of the invention as installed in an aircraft for supplying overheat detection in the wing, fuselage, and cowling.

FIG. 7 is a top plan view of the thermal switch 10 of the present invention embodied as a snap-action thermal switch 10 having a resistor 12 coupled in parallel with the switch contacts 14, 16 (shown in FIGS. 2, 3) and installed in a housing 56 that is configured for mounting in an aircraft wing, fuselage, or cowling, as shown in FIG. 17. FIG. 8 is a break-away side view of the snap-action thermal switch 10 of the present invention embodied as shown in FIG. 7. The housing 56 may include a threaded adapter member 58 for mounting, either in a threaded hole or through a clearance hole with a nut. An over-mold 60 is formed over and encases the thermal switch 10, the resistor 12 (shown mounted externally), the terminal posts 20, 22, and partially encases a pair of contact adapters 62, 64 that are electrically coupled to the terminal posts 20, 22, respectively. The contact adapters 62, 64 are internally threaded to enable the thermal switch 10 to be electrically coupled into the overheat detection system. The over-mold 60 is formed of an electrically insulative material, such as one of the conventional high-temperature thermo-plastic or thermo-set materials. The over-mold 60 may include an integral physical barrier portion 66 to protect against inadvertent contact between connectors (not shown) that are attached to the contact adapters 62, 64 for installing the switch 10 into the overheat detection system.

Figure 9:
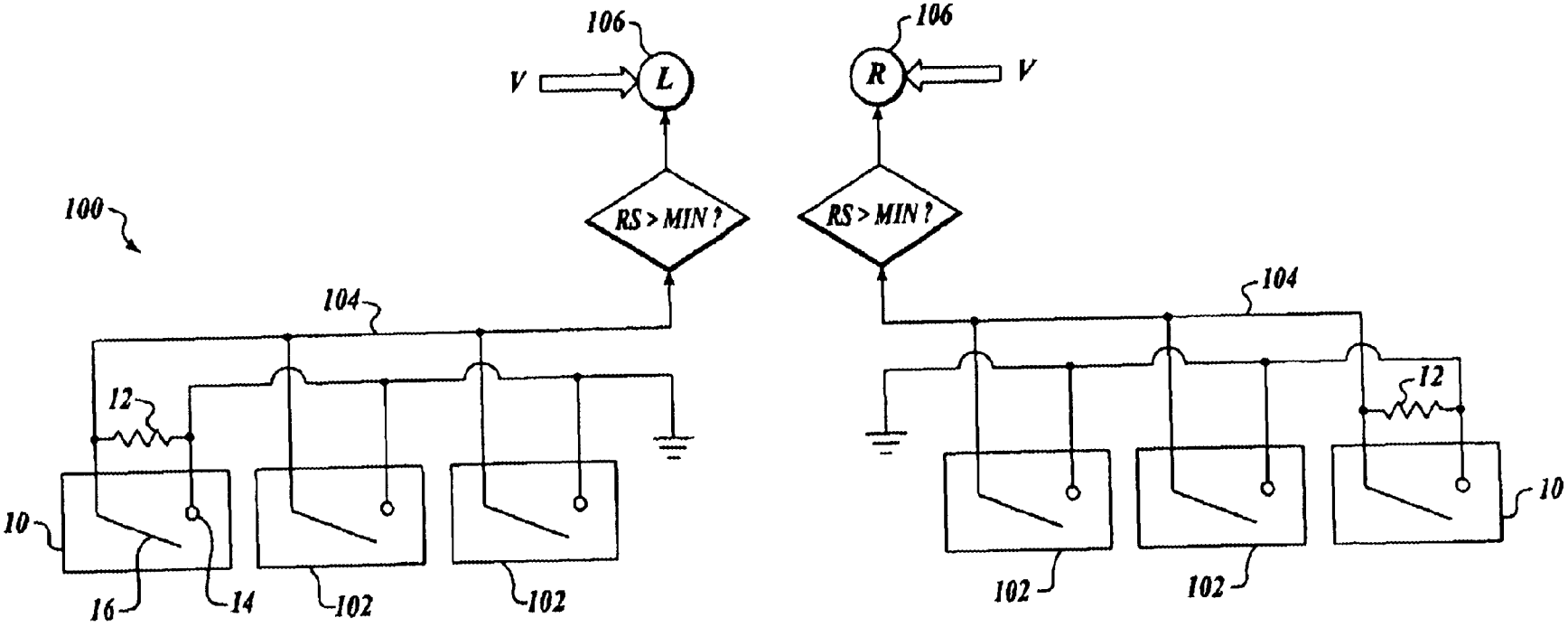
FIG. 9 is an illustration of the thermal switch of the invention implemented in an overheat detection system having one of the thermal switches coupled in parallel with a quantity of conventional snap-action thermal switches that do not include the resistor.

FIG. 9 illustrates the thermal switch 10 of the invention implemented in an overheat detection system 100 having one of the thermal switches 10 coupled in parallel with a quantity of conventional snap-action thermal switches 102 that do not include the resistor 12. The single thermal switch 10 of the invention and the conventional thermal switches 102 are electrically coupled together in parallel by a wire harness 104, which is led to an indicator 106. In a conventional overheat detection system, the indicator 106 provides a visual and/or an aural indication of an overheat condition sensed by the overheat detection system. In other words, if one of the conventional thermal switches 102 responds to an overheat condition by closing its electrical contacts, whereby the circuit formed with the wire harness 104 is closed, the indicator 106 is connected to a voltage source V. The indicator 106 responds by either emitting an aural warning or displaying a visual warning of the overheat condition.

According to the embodiment of the overheat detection system 100 illustrated in FIG. 9, the wiring harness 104 exhibits a nominal resistance $R_N$ resulting from the electrical wire in the harness 104. The single thermal switch 10 is coupled into the overheat detection system 100 as the end switch. Thus, when the thermal switch 10 is on-line and in the intended normally-open state, the resistor 12 appears on the wiring harness 104 as a minimum resistance $R_T$ in addition to the nominal resistance $R_N$. Thus, the thermal switch 10 is detected as being on-line when a system resistance $R_S=R_N+R_T$ is detected by a logic circuit 108. Detection of the thermal switch 10 ensures that the wiring harness 104 is intact and operational, even though the connections of the conventional thermal switches 102 are not indicated.

Figure 10:
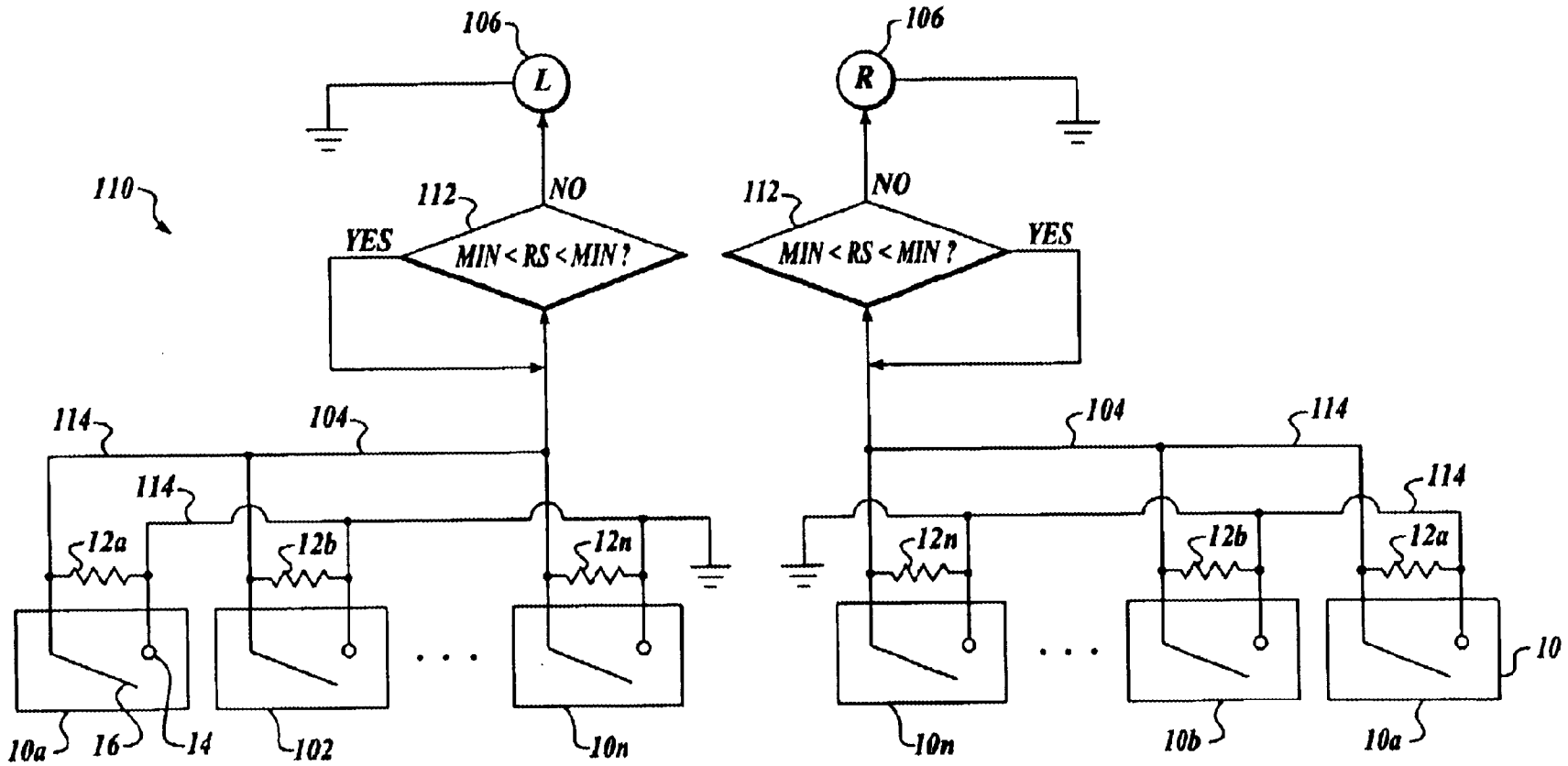
FIG. 10 illustrates the thermal switch of the invention implemented in an alternative overheat detection system having a quantity of thermal switches of the invention coupled together in parallel in a wiring harness, which is led to an indicator through a logic circuit.

FIG. 10 illustrates the thermal switch 10 of the invention implemented in an alternative overheat detection system 110 having a quantity of thermal switches 10*a*, 10*b* through 10*n* of the invention coupled together in parallel in the wiring harness 104, which is led to the indicator 106 through a logic circuit 112. The logic circuit 112 samples the total system resistance $R_S=R_N+R_{Ta}+R_{Tb}\ldots+R_{Tn}$ of the detection system 110 at a predetermined sampling rate, wherein $R_N$ is the nominal resistance of the wiring harness 104 and $R_{Ta}$ through $R_{Tn}$ are the resistances of the resistors 12 of the respective thermal switches 10*a* through 10*n*.

As embodied in FIG. 10, the indicator 106, as part of the overheat detection system 110 of the invention, additionally provides a fault indication when the resistance $R_S$ of the system 110 detected by the logic circuit 112 fails to fall between a minimum and a maximum threshold resistance. The overheat detection system 110 employs a number of the thermal switches 10 of the invention, each including one of the resistors 12, that provide at least a minimum resistance $R_S$ that is below the maximum threshold resistance only when all of the resistors 12*a* through 12*n* are coupled together in parallel. If the resistor 12 of one of the normally-open thermal switches 10 is removed from the system circuit, then the overall resistance of the system 110 is increased above the maximum threshold, and the indicator 106 indicates a fault. Thus, the thermal switch 10 of the invention having the resistor 12 coupled in parallel with the electrical contacts 14, 16 provides a means for determining that all of the thermal switches 10 of the overheat detection system 110 are on-line. The thermal switch 10 of the invention further provides a means for confirming the integrity of the wire harness 104 by indicating a fault unless the resistance provided by the resistor 12 portion of each of the switches 10 appears on-line. If the electrical contacts 14, 16 one of the thermal switches 10 are closed, instead of being in the normally-open state, the system circuit is CLOSED and the system resistance $R_S$ is reduced to the actual resistance in the interconnecting wires of the wiring harness 104, which is reduced below the minimum threshold resistance. Thus, in a self-test mode, a switch 10 that fails in the closed state results in a fault indication. Similarly, when a switch 10 of the invention closes in response to an overheat condition, a fault indication results on the indicator 106.

According to one embodiment of the invention, a quantity of the thermal switches 10*a* through 10*n* of the invention, each including a respective resistor 12*a* through 12*n* coupled in parallel with the electrical contacts 14, 16, are coupled to a pair of wire harnesses 104. The thermal switches 10*a* through 10*n* and a respective wire harness 104 are deployed on one of the left and right sides of an aircraft to detect overheat conditions in the respective aircraft wing, fuselage, and cowling, as shown in FIG. 17.

Figure 11:
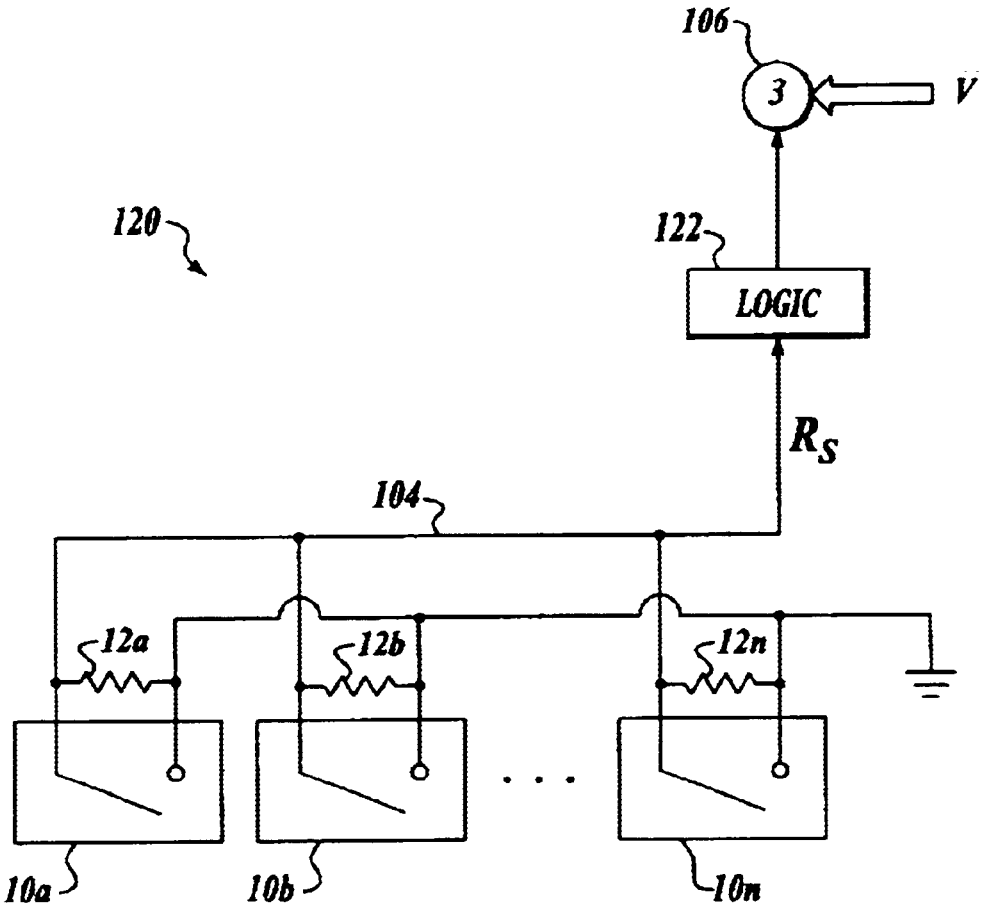
FIG. 11 illustrates an alternative embodiment of the overheat detection system of the invention, wherein each of the multiple parallel-coupled thermal switches of the invention is embodied having respective resistor electrically coupled in parallel with the switch contacts and wherein each of the resistors has a resistance value different from that of the other resistors coupled to the other switches.

FIG. 11 illustrates the overheat detection system embodied as an alternative overheat detection system 120, wherein each of multiple parallel-coupled thermal switches 10*a*, 10*b*, through 10*n* of the invention is embodied having respective resistor 12*a*, 12*b*, through 12*n* electrically coupled in parallel with the switch contacts 14, 16. Each of the resistors 12*a* through 12*n* has a resistance value different from that of the other resistors 12*a* through 12*n*. A logic circuit 122 is coupled in series with each of the parallel-coupled thermal switches 10*a* through 10*n* for detecting a resistance $R_S$ that is the combined resistances of all of the resistors 12*a* through 12*n*, plus the nominal resistance of the wiring harness 104. The logic circuit 122 is structured to detect whether the total system resistance $R_S$ of the system 120 is between the minimum and a maximum threshold resistance, as described above. The logic circuit 122 is thus structured to detect whether the wiring harness 104 is intact and functional and whether all of the thermal switches 10*a* through 10*n* are on-line.

The logic circuit 122 is further structured, by means known to those of ordinary skill, to detect the actual resistance $R_S$ of the overheat detection system 120 and, when a failure is detected, to determine from the actual resistance $R_S$ which of the multiple thermal switches 10*a* through 10*n* is off-line or closed.

Figure 12:
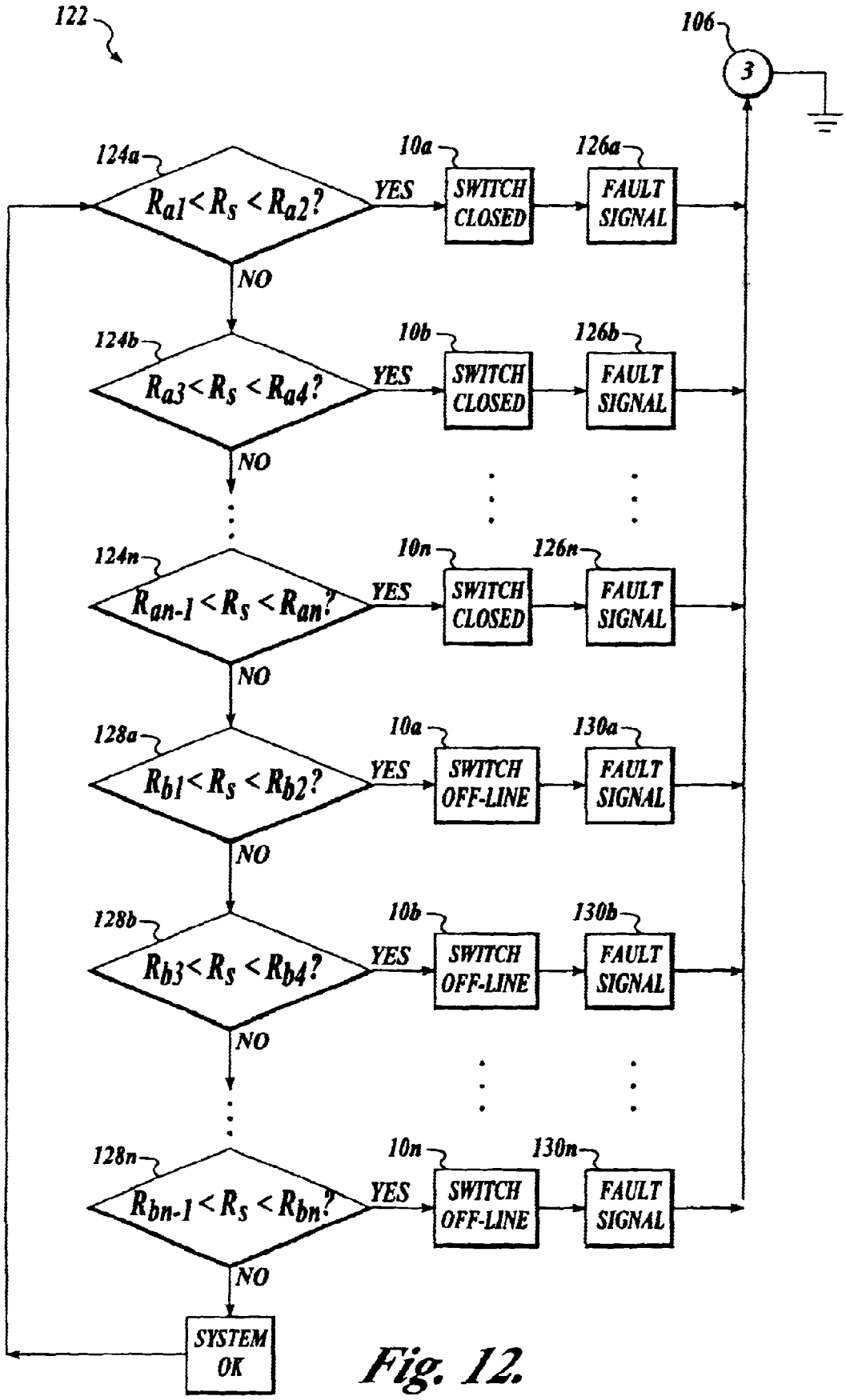
FIG. 12 illustrates an exemplary flow diagram of one optional embodiment of the logic circuit shown in FIG. 11.

FIG. 12 illustrates the logic circuit 122 embodied in an exemplary flow diagram, wherein the logic circuit 122 includes a series of widow comparitor circuits 124*a* through 124*n* each being structured to determine whether the resistor 12*a* through 12*n* of the respective thermal switches 10*a* through 10*n* is on-line, or is missing from the circuit. In other words, failure to detect one specific resistance value indicates that a particular resistor 12*m* is no longer part of the circuit resistance $R_S$, and that the respective switch 10*m* is off-line, ie., disconnected. For example, the value of the resistance $R_S$ of the overheat detection system 120 is between predetermined minimum and maximum resistance couples $R_{a1}$ and $R_{a2}$ through $R_{an-1}$ and $R_{an}$. Such a fault is optionally determined by applying a voltage V to the system 120 during a pre-flight self-test operation. If any of the thermal switches 10*a* through 10*n* is determined to be off-line, a respective fault signal 126*a* through 126*n* is generated and passed to the fault indicator 106, which indicates the fault in the cockpit. Constant sampling at a predetermined sampling rate during operation causes the logic circuit 122 to continue to monitor the circuit resistance $R_S$ for presence on-line of the multiple thermal switches 10*a* through 10*n*.

Furthermore, the logic circuit 122 includes another series of widow comparitor circuits 128*a* through 128*n* each being structured to determine whether the resistors 12*a* through 12*n* of the respective thermal switches 10*a* through 10*n* are on-line, or whether one has been replaced by the minimal resistance of the closed switch contacts 14, 16 in series with the wire resistance of the parallel portion of the wiring harness 104, which indicates that the respective switch 10 has closed in response to an overheat situation. If any of the thermal switches 10*a* through 10*n* is determined to be closed, a fault signal 130*a* through 130*n* is generated and passed to the fault indicator 106, which indicates the fault in the cockpit. Constant sampling at a predetermined sampling rate during operation causes the logic circuit 122 to continue to monitor the circuit resistance $R_S$ for presence on-line of the multiple thermal switches 10*a* through 10*n*.

Figure 13A:
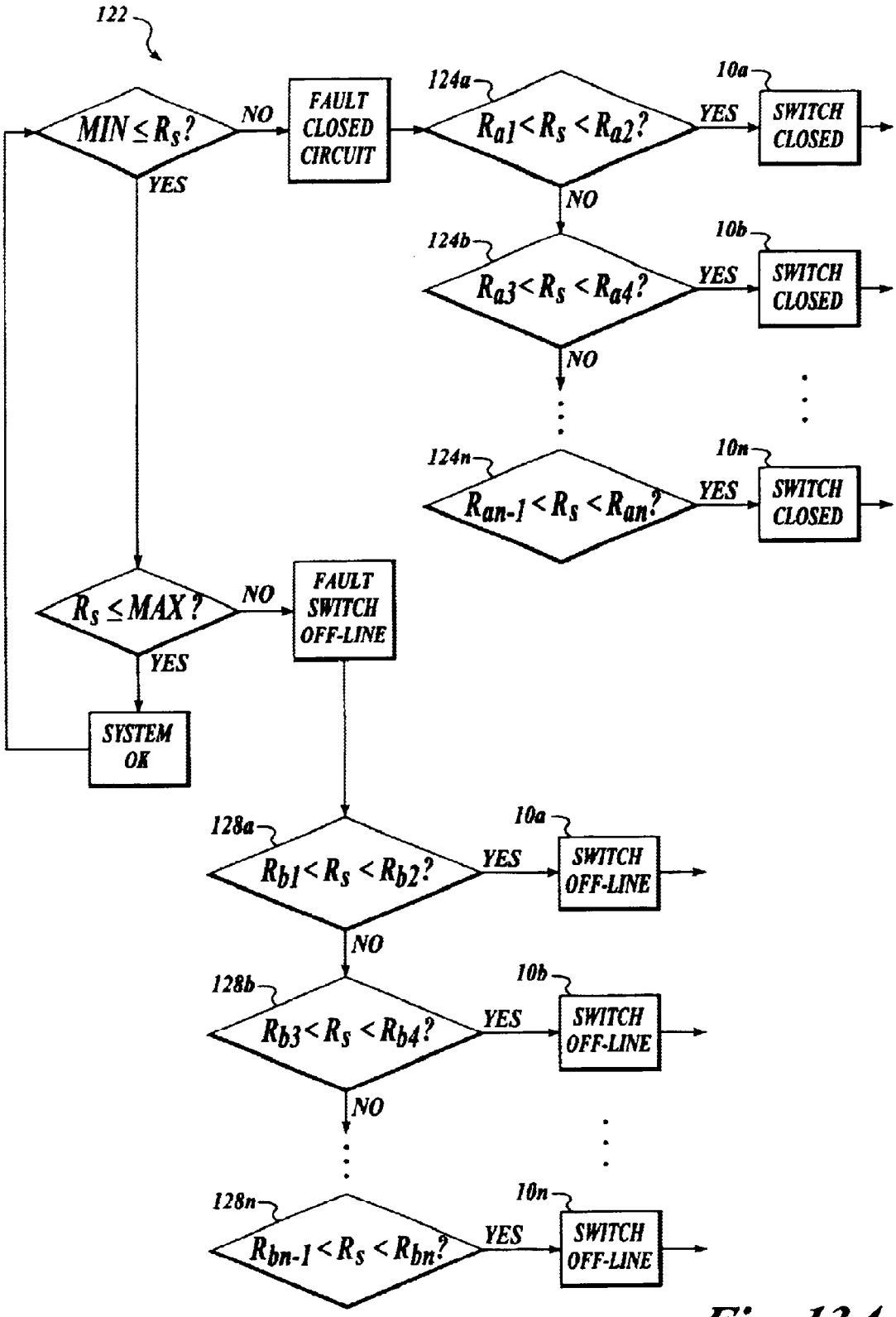
FIGS. 13A and 13B together illustrates the logic circuit embodied according to an alternative exemplary flow diagram, wherein the logic circuit includes the structure of the embodiment illustrated in FIG. 11, but also includes a front-end portion that provides an initial state determination before attempting to isolate a fault.
Figure 13B:
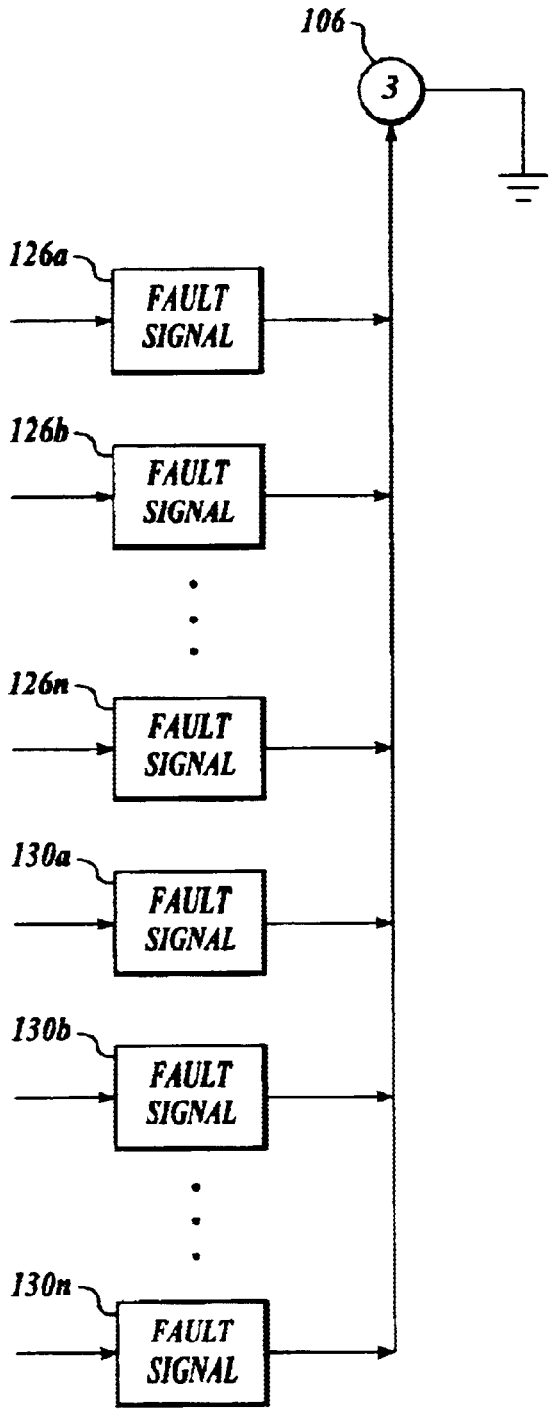

FIGS. 13A and 13B together illustrates the logic circuit 122 embodied according to an alternative exemplary flow diagram, wherein the logic circuit 122 includes the structure of the embodiment illustrated in FIG. 11, but also includes a front-end portion that provides an initial state determination before attempting to isolate a fault. For example, the logic circuit 122 includes a first state determination window comparitor 132 for determining whether all of the switches 10*a* through 10*n* are on-line by, for example, determining whether the overall resistance $R_S$ of the overheat detection system 120 is between the predetermined minimum and maximum resistance thresholds. Such a fault is optionally determined by applying a voltage V to the system 120 during a pre-flight self-test operation. If the overall resistance $R_S$ is outside the minimum and maximum limits, the signal is passed through the respective window comparitors 124*a* through 124*n* to determine which of the thermal switches 10*a* through 10*n* is off-line and to generate the fault signal 126*a* through 126*n* that corresponds to the switch 10*a* through 10*n* that is off-line. As described above, the fault indicator 106 indicates the fault in the cockpit in response to the respective fault signal 126*a* through 126*n* received.

Figure 14:
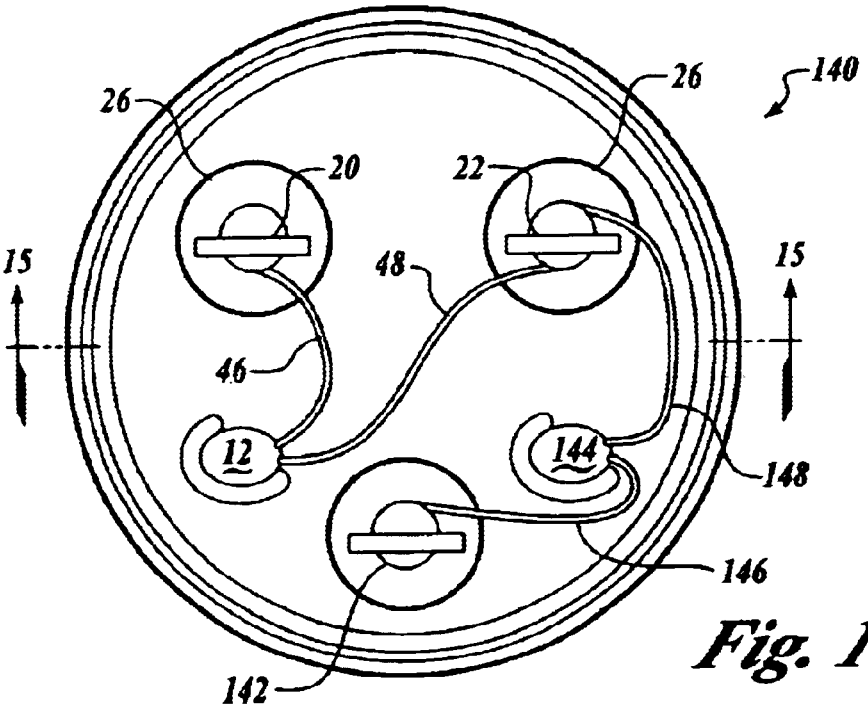
FIG. 14 illustrates the thermal switch of the invention embodied as a three-terminal switch.

FIG. 14 illustrates the thermal switch of the invention embodied as a three-terminal switch 140 having a third electrically conductive terminal post 142 using an electrical isolator 26. The third terminal post 142 is a contact-less post that is physically spaced-apart from each of the first pair of terminal posts 20 and 22. A second resistor 144 is mounted on the header and electrically coupled between the contact-less terminal post 142 and one of the first pair of terminal posts 20 and 22 (shown as coupled to post 22) by respective lead wires 146, 148.

Figure 15:
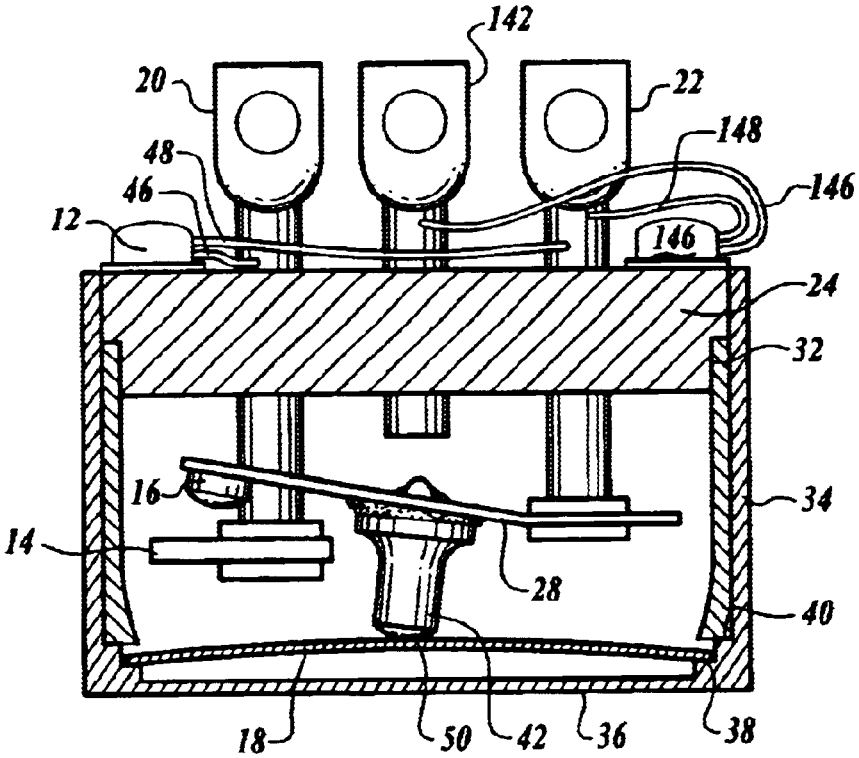
FIG. 15 is a cross-sectional view of the three-terminal thermal switch illustrated in FIG. 14.

FIG. 15 is a cross-sectional view of the three-terminal thermal switch 140 shown in FIG. 14.

Figure 16:
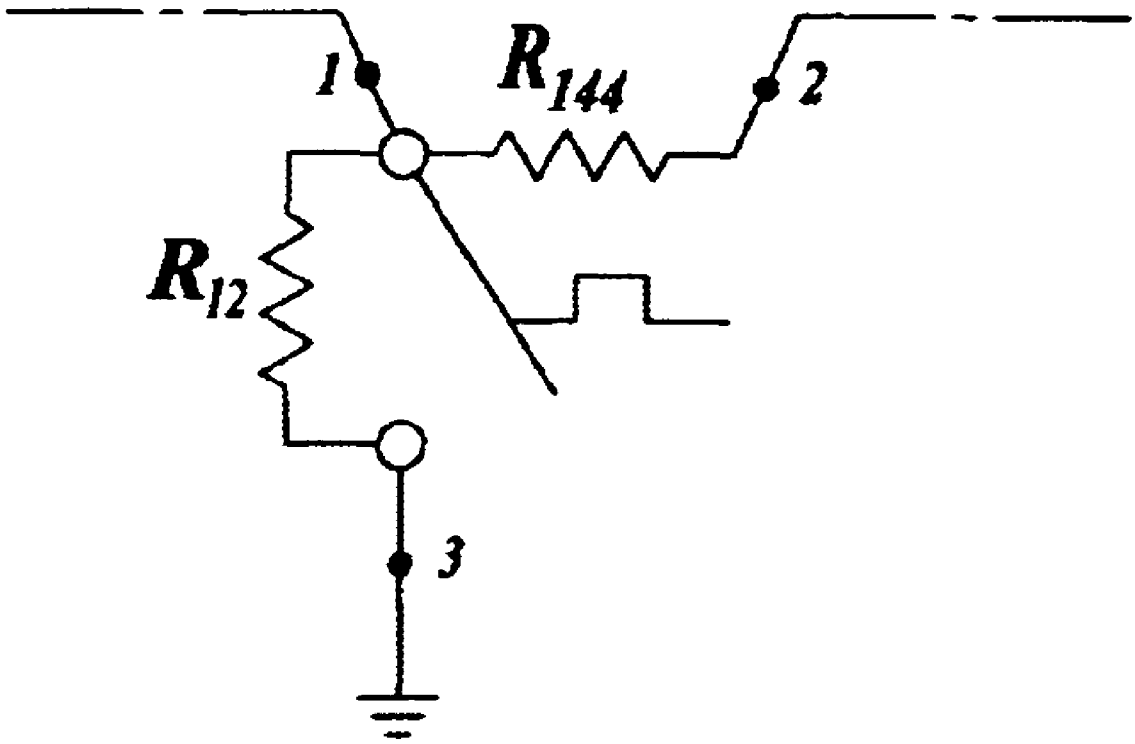
FIG. 16 is a schematic description of the three-terminal thermal switch shown in FIGS. 14 and 15.

FIG. 16 is a schematic description of the three-terminal thermal switch 140 shown in FIGS. 14 and 15. As illustrated, the three-terminal thermal switch 140 is structured such that a resistance R144 is remains when the switch contacts 14, 16 are closed. The switch 140 otherwise operates similarly to the above described thermal switch 10.

FIG. 17 illustrates the overheat detection system 100, 110, 120 having the thermal switch 10, 140 of the invention as installed in an aircraft 150 for supplying overheat detection in the wing, fuselage, and cowling. The overheat detection system 100, 110, 120 includes the thermal switch 10, 140 installed in the wiring harness 104. As described above, the thermal switch 10, 140 is either used throughout the overheat detection system 100, 110, 120 or coupled in parallel with a quantity of conventional snap-action thermal switches 102. The overheat detection system 100, 110, 120 is operated as described above to perform a pre-flight self-test operation, to detect overheat situations, to generate and display an appropriate fault signal, and optionally to determine the specific thermal switch 10, 140 is responsible for the fault signal.

While the preferred embodiment of the invention has been illustrated and described, it will be appreciated that various changes can be made therein without departing from the spirit and scope of the invention.

What is claimed is:

1. A thermal sensor, comprising:

a plurality of snap-action thermal switches each having first and second electrical contacts structured in a normally open configuration, each first contact being movable relative to the respective second contact, and an actuator positioned relative to each first electrical contact and responsive to different sensed temperatures for alternately positioning the respective first movable contact into contact with and spaced away from the respective second contact;

an electrical resistor coupled between the respective first and second contacts of one or more of the plurality of snap-action thermal switches;

a wiring harness having the plurality of snap-action thermal switches electrically coupled thereto in parallel; and a means for determining whether each of the plurality of snap-action thermal switches is electrically coupled to the wiring harness.

2. The thermal sensor of claim 1 wherein the actuator further comprises a bi-metallic actuator having first and second physical states, the first state being structured to space the first movable contact away from the second contact, and the second state being structured to permit the first movable contact to contact the second contact.

3. The thermal sensor of claim 1 wherein the electrical resistor is integral with the switch.

4. The thermal sensor of claim 1 wherein two or more of the plurality of switches further comprises an electrical resistor coupled between the respective first and second contacts.

5. A thermal sensor, comprising:

a single-pole, single-throw switch having first and second electrical contacts structured in a normally open configuration, the first contact being movable relative to the second contact;

an actuator positioned relative to the first electrical contact and responsive to a sensed temperature for spacing the first movable contact away from the second contact, the actuator being a bi-metallic actuator having first and second physical states, the first state being structured to space the first movable contact away from the second contact, and the second state being structured to permit the first movable contact to contact the second contact;

an electrical resistor coupled between the first and second contacts and being integral with the single-pole, single-throw switch;

a wiring harness having the single-pole, single-throw switch with the electrical resistor electrically coupled thereto;

a plurality of snap-action thermal switches electrically coupled in parallel with the single-pole, single-throw switch, each of the plurality of snap-action thermal switches comprising:

a single-pole, single-throw switch having first and second electrical contacts structured in a normally open configuration, the first contact being movable relative to the second contact, and an actuator positioned relative to the first electrical contact and responsive to a sensed temperature for spacing the first movable contact away from the second contact, and wherein one or more of the plurality of snap-action thermal switches further comprises an electrical resistor coupled between the first and second contacts; and a means for determining whether each of the plurality of snap-action thermal switches is electrically coupled to the wiring harness.

6. The thermal sensor of claim 4, further comprising a means for determining for one or more of the plurality of snap-action thermal switches whether the first movable contact is spaced away from the second contact.

7. The thermal sensor of claim 4, further comprising a logic circuit structured to determine for one or more of the plurality of snap-action thermal switches whether the electrical resistor is coupled to the wiring harness.

8. The thermal sensor of claim 7, further comprising a logic circuit structured to determine for one or more of the plurality of snap-action thermal switches whether the first movable contact is spaced away from the second contact.

* * * * *